US005178484A

United States Patent [19]

Strunk

[11] Patent Number: 5,178,484

[45] Date of Patent: Jan. 12, 1993

[54] APPARATUS TO PREPARE A ROAD SURFACE

[75] Inventor: Wayne D. Strunk, La Pine, Oreg.

[73] Assignee: Carolyn E. Strunk, Bend, Oreg.

[21] Appl. No.: 770,091

[22] Filed: Oct. 1, 1991

Related U.S. Application Data

[63] Continuation of Ser. No. 427,294, Oct. 26, 1989, Pat. No. 5,054,958.

[51] Int. Cl.[5] ..... E01C 7/04

[52] U.S. Cl. ..... 404/75; 404/91; 404/96

[58] Field of Search ..... 404/75, 83, 90–92, 404/96, 81; 299/29, 36, 64; 241/198 A, 198 R, 202; 172/826, 743, 776

[56] References Cited

U.S. PATENT DOCUMENTS

| | | | |
|---|---|---|---|
| 1,354,076 | 9/1920 | Stephens | 404/91 |
| 2,046,417 | 7/1936 | Talbot et al. | 94/44 |
| 2,368,331 | 1/1945 | Seaman | 94/40 |
| 2,447,303 | 8/1948 | Anderson | 241/155 |
| 2,539,136 | 1/1951 | Hite . | |
| 3,219,388 | 11/1965 | Haynes | 299/37 |
| 3,452,461 | 7/1969 | Hanson . | |
| 3,510,073 | 6/1967 | Mailliard . | |
| 3,556,415 | 1/1971 | Winter | 241/30 |
| 3,656,696 | 4/1972 | Mailliard | 241/155 |
| 4,011,023 | 3/1977 | Cutler | 404/91 |
| 4,185,875 | 1/1980 | Swisher | 404/91 X |
| 4,573,826 | 3/1986 | Piovesan | 404/90 |
| 4,637,753 | 1/1987 | Swisher | 404/90 |
| 4,676,688 | 6/1987 | Caradot | 404/91 |

FOREIGN PATENT DOCUMENTS

| | | |
|---|---|---|
| 162792 | 11/1985 | European Pat. Off. . |
| 2566020 | 12/1985 | France . |
| 2566380 | 12/1985 | France . |
| 2589834 | 5/1987 | France . |
| 2600355 | 12/1987 | France . |

*Primary Examiner*—Ramon S. Britts
*Assistant Examiner*—Roger J. Schoeppel
*Attorney, Agent, or Firm*—Klarquist, Sparkman, Campbell, Leigh & Whinston

[57] ABSTRACT

A multi-purpose apparatus to prepare a road surface is disclosed. The apparatus includes a scoop which cuts, profiles and collects material. A conveyor connected to the scoop transports the material from the scoop to a rock crusher. The rock crusher reduces the size of the rock and deposits the crushed rock back on the road bed. An articulated bucket assembly is mounted on the apparatus to excavate overburden and to deposit the overburden into the scoop.

12 Claims, 5 Drawing Sheets

FIG. 7A
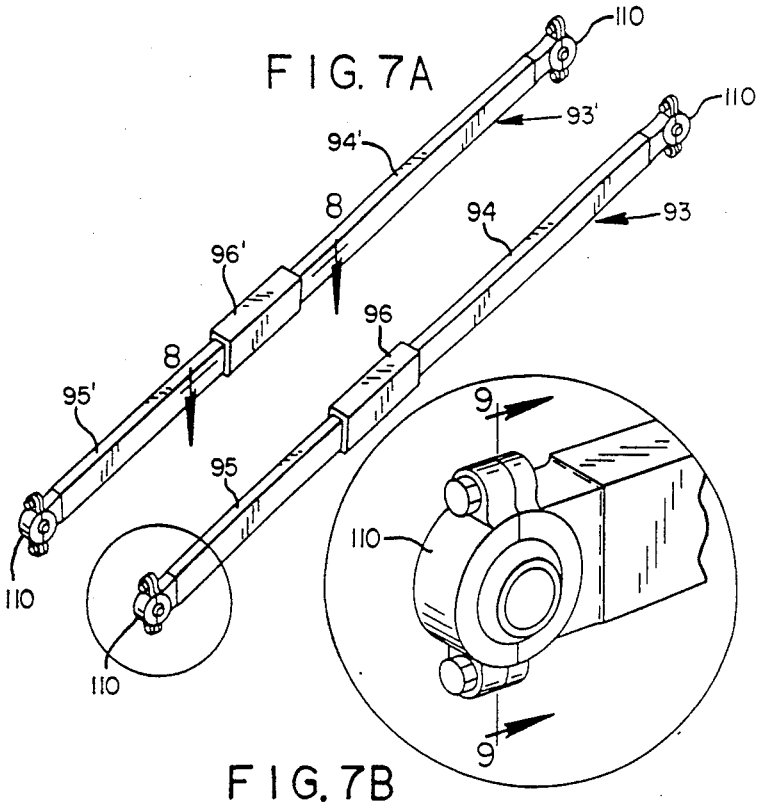
FIG. 7B
FIG. 8
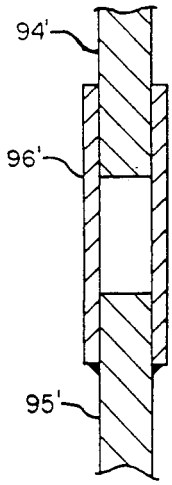
FIG. 9
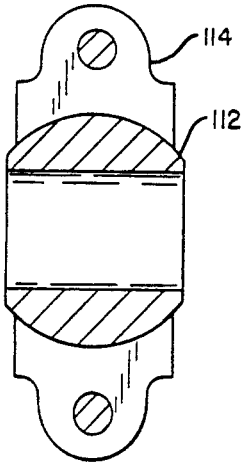
FIG. 10
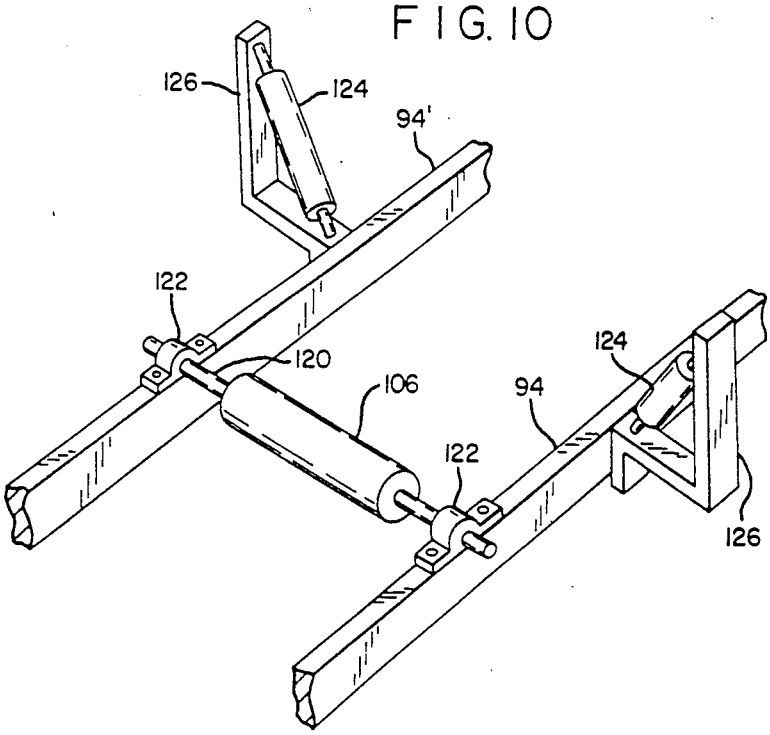

APPARATUS TO PREPARE A ROAD SURFACE

This is a continuation of application Ser. No. 07/427,294, filed Oct. 26, 1989 now U.S. Pat. No. 5,054,958.

TECHNICAL FIELD

This invention relates to an apparatus for preparing a road bed, specifically the apparatus profiles the road surface, collects oversize material, crushes the oversize material and deposits the crushed material on the road bed.

BACKGROUND OF THE INVENTION

Preparation of road beds in mountainous rocky terrain is extremely expensive. Timber and undergrowth must be cleared and removed. Rock and other unwanted overburden must be removed. The contour of the surface must be prepared. Stone, sand or other underlayment must be trucked to the site, smoothed, profiled and compacted. Finally, the road surface, whether asphaltic compositions, concrete or rock, must be laid.

All of these various functions are performed by specialized equipment, such as bulldozers, pan scrapers, cranes, excavators, drag buckets and graders. Highly paid personnel are required to operate this equipment. The cost of the equipment, the cost to transport the equipment to and from the work site, and operators wages all add to the expense of preparing the road bed.

The greatest number of miles of these mountainous roads are not paved for passenger car usage, but have a crushed rock surface and are used for access to timber harvesting sites, power line maintenance roads, fire prevention access roads and pipe line maintenance roads. The cost of the timber harvested and power and gas transmission costs are directly related to the cost of the roads necessary to secure, maintain or transport that resource.

One of the major expenses in preparing a road bed in rocky terrain is the removal of rock which is oversize for the bed surface and replacement of this rock material with properly sized rock. Currently, the least expensive method of road construction is to remove the oversize rock and deposit the rock in fill areas or in a waste tailing area. Properly sized crushed rock is then purchased from a supplier and trucked to the site as needed. An alternative is to temporarily erect a rock crushing machine in an area near the road work, carry the rock to this area, crush the rock and then transport the crushed rock back to the road bed. This approach reduces the transportation cost and eliminates the need to purchase crushed rock, but requires preparation of a site to erect the crushing apparatus which adds to the cost of preparing the road. Also, this alternative is often not practical because of the topography of the terrain and the unavailability of specialized rock crushing equipment.

It is, therefore, an object of this invention to provide an apparatus which can assist in preparing a road bed by crushing rock at the road building site.

It is a further object of the invention to have a self-propelled apparatus which loads and crushes rock without the need of additional equipment.

It is also an object of the invention to provide an apparatus which can perform excavating and road surface profiling.

A further object is to provide an apparatus wherein multiple road working functions can be performed by a single operator from a single operating position.

Another object of the invention is to provide a road bed preparation device which can operate on unimproved surfaces.

Other objects and advantages of the present invention will be apparent from the following description of a preferred embodiment thereof and from the attached drawings.

DISCLOSURE OF THE INVENTION

The only practical way to reduce the cost of building a road bed is to reduce the amount of equipment and the number of equipment operators necessary to prepare the road bed. This invention solves this problem by providing a self-propelled apparatus to perform a plurality of functions necessary to prepare a road bed. An internal combustion engine drives a plurality of hydraulic pumps. A hydraulically driven pair of tracked drives are used to support, propel and steer the apparatus. A frame interconnects the drive tracks and the other components of the apparatus.

A scoop is interconnected to the frame by a pair of push arms. Fluid cylinders control the angle of attack of the scoop, the tilt and the rotation of the scoop. The scoop profiles the road surface by cutting away overburden and unwanted earth and rock. The scoop also collects the overburden. A conveyor transports the overburden from the scoop to a crusher. The crusher reduces the size of the rock to a size acceptable for depositing on the road bed.

An articulated bucket assembly having a boom, an arm, and a bucket is located on the frame. The bucket assembly is used to excavate the overburden and to deposit the material in the scoop. A thumb is mounted on the arm to work in conjunction with the bucket to lift or move oversize material.

The apparatus can prepare a road surface by excavating material, profiling the road surface, crushing rock in situ, and placing the crushed rock back on the road bed.

DESCRIPTION OF THE DRAWINGS

FIG. 7A is a perspective view of the conveyor support arms of the FIG. 6 embodiment of the present invention, and FIG. 7B is an enlarged perspective view of the encircled portion of FIG. 7A.

FIG. 8 is a cross-section of the slip joint of a conveyor support arm of the present invention, taken along lines 8—8 of FIG. 7A.

FIG. 9 is a cross-section of the spherical ball connector of the end of a conveyor support arm of the present invention, taken along lines 9—9 of FIG. 7B.

FIG. 10 is a partial perspective view of a portion of the conveyor support arm of the FIG. 6 embodiment of the conveyor, having conveyor support rollers attached thereto.

DETAILED DESCRIPTION OF THE INVENTION

Figure 1:
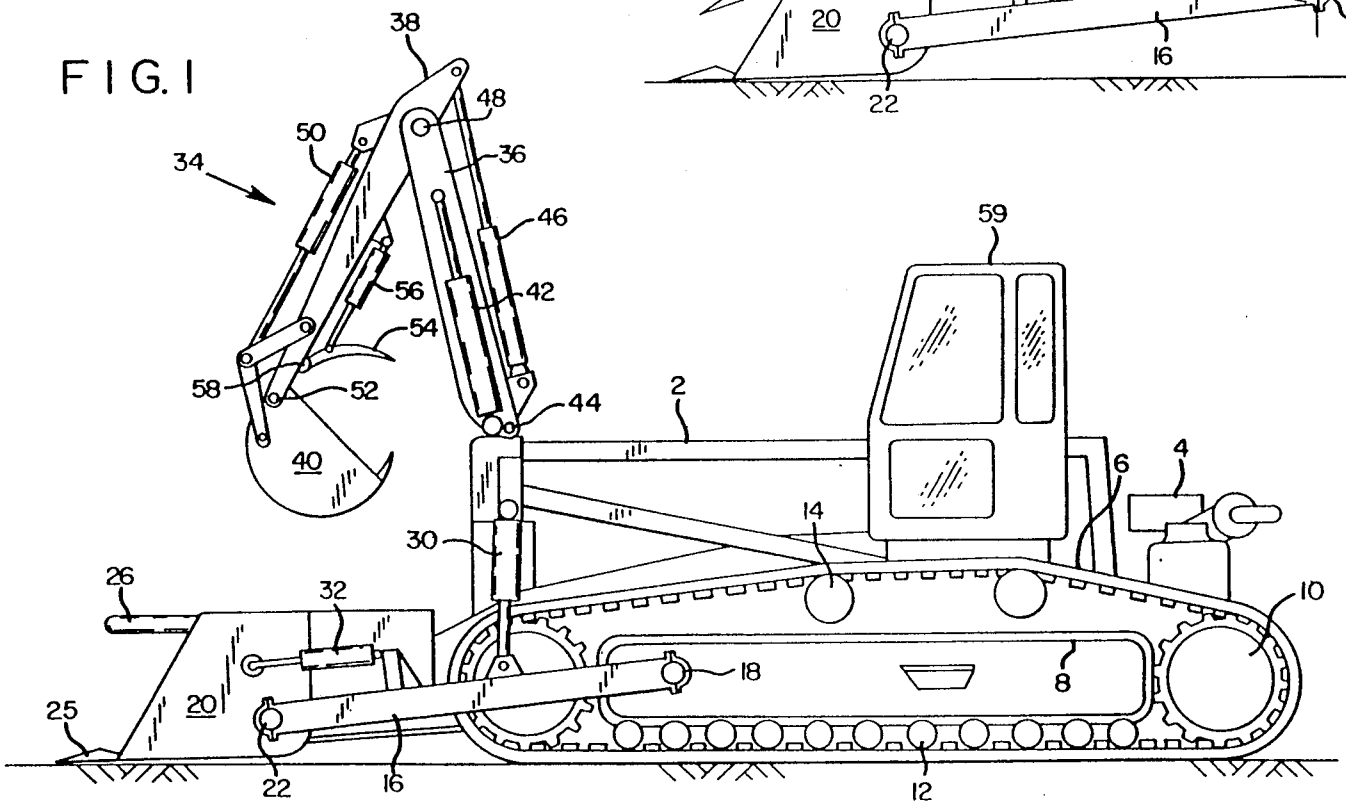
FIG. 1 is a side view of the apparatus for preparing a road surface of the present invention.
Figure 2:
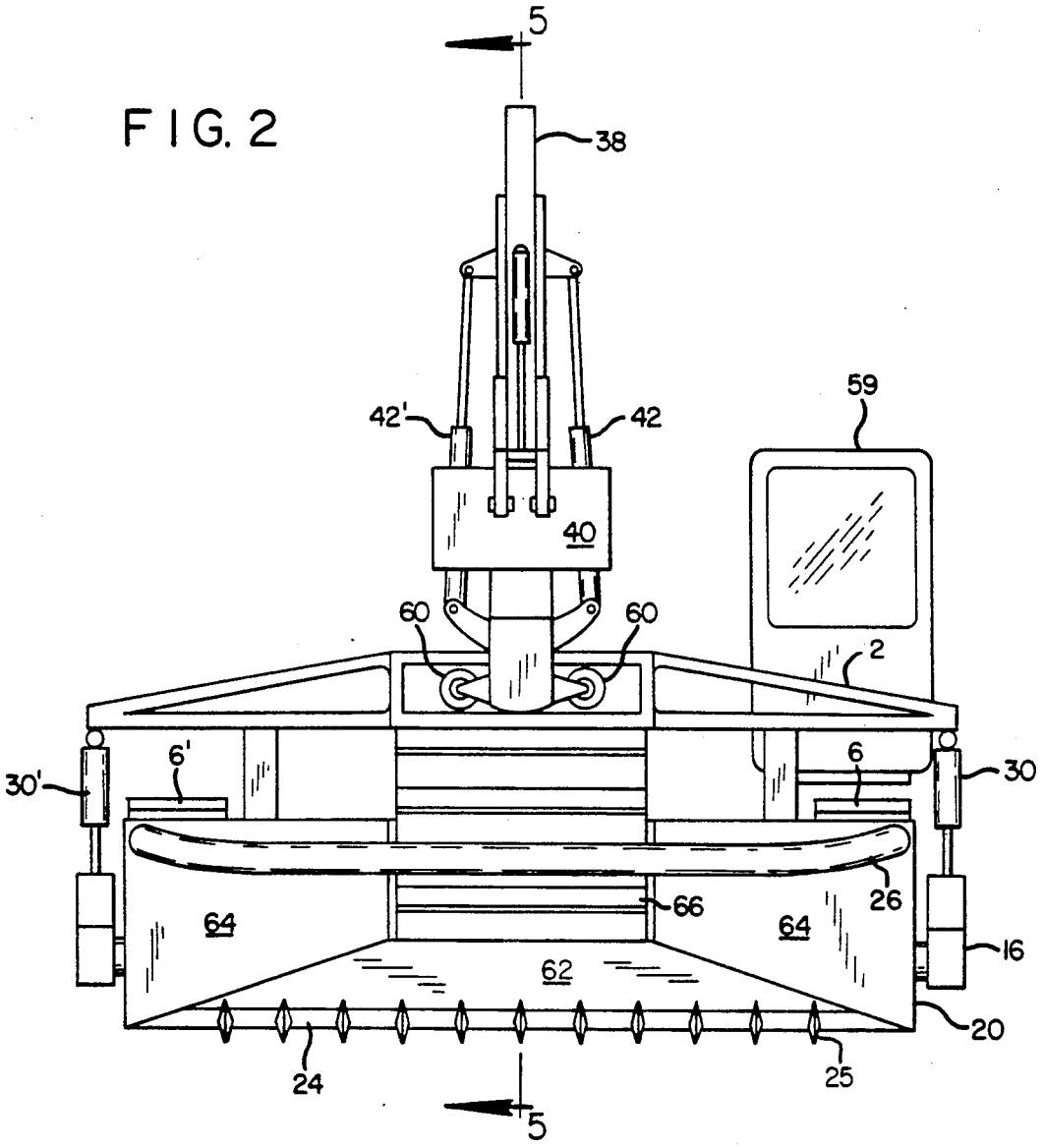
FIG. 2 is a front view of the apparatus for preparing a road surface of the present invention.

Referring to FIG. 1 and FIG. 2, a frame 2 interconnects all of the components of the apparatus to prepare a road surface. The frame 2, in the preferred embodiment, is manufactured of structural steel members having bracketry and other elements attached thereon to connect all of the components of a multi-purpose machine to prepare a road surface. The apparatus is driven by an internal combustion engine 4 mounted on the frame 2. The engine 4 typically is a 195 SAE horsepower turbocharged diesel engine. The diesel engine 4 has three open center pumps (not shown) mounted in line and coupled directly to the flywheel of the engine 4. The total flow of the hydraulic pumps is typically 175 gallons per minute per pump at rated engine rpm. One of the pumps is used to propel the apparatus and has an operating pressure of approximately 2,800 pounds per square inch. The remaining two pumps have a rated pressure of approximately 2,700 pounds per square inch and drive the other components of the apparatus.

A pair of tracked undercarriages 6 and 6' are used for propulsion of the apparatus. The tracked undercarriages 6 and 6' allow the apparatus to be used on unimproved terrain. The tracked undercarriages are similar to the undercarriages used on bulldozers, excavators and crane devices. Each of the tracked undercarriages has a track undercarriage frame 8. Each track frame 8 is a formed reinforced U-channel section. The track frame is rigidly mounted to the frame 2 of the apparatus. The tracks 6 and 6' are each driven by a high torque, axial piston, variable speed hydraulic motor 10, with planetary drives. There is one motor per track. Multiple disc brakes automatically release while the apparatus is being propelled and apply when the apparatus is stationary. Independent drive to each track undercarriage permits counter-rotation and, therefore, steering of the apparatus. Each track undercarriage assembly 6 is supported on the track undercarriage frame 8 by nine lower rollers 12 and two upper rollers 14.

A push bar 16 having a first end and a second end is connected at its first end to the undercarriage frame 8 by means of a spherical ball joint 18. The push bar 16 is attached at its second end to a bucket 20 by means of a similar spherical ball joint assembly 22. Spherical ball joint assemblies 18 and 22 allow the push bar 16 to move up and down about the fixed pivot point on the undercarriage frame 8 and also allows a limited amount of axial rotation of the scoop 20.

Scoop 20 has a replaceable leading edge 24. This leading edge 24, in one embodiment, has a smooth cutting surface. Alternate embodiments may have various attachments, such as rock guards 25 as shown in FIG. 1. The scoop acts to remove overburden or unwanted material from the road surface, much like a bulldozer. An alternate embodiment of the leading edge may have chip breakers to tear up existing asphaltic pavements.

The upper portion of scoop 20 has a deflector 26 mounted on the upper portion thereof to prevent material larger than a predetermined diameter from entering the scoop. In a preferred embodiment, deflector 26 is attached approximately 36 inches above the replaceable cutting edge 24. Thus, the deflector 26 will push to the side any rock or other material with a diameter greater than 36 inches. In an alternate embodiment, this deflector can be set 24 inches above the cutting edge 24 to exclude any material having a diameter greater than 24 inches.

A pair of lift cylinders 30 and 30', each having a first end and a second end, are attached on their first end on each side of the apparatus to the frame 2 and on their second end to push bar 16. These lift cylinders can be operated independently and can adjust the lift of the push bar and, hence, the height of the scoop 20. A second pair of hydraulic cylinders 32 and 32', each having a first end and a second end, have their first end attached to a bracket attached to the push arm 16 and the second end attached to the scoop 20. This allows the scoop to be rotated about the spherical ball joint 22 of push bar 16. The range of motions and the various actions caused by the first pair of lift cylinders 30 and the second pair of rotational cylinders 32 will be explained below.

An excavator bucket assembly 34 is mounted on frame 2. The excavator bucket assembly is used to remove overburden not accessible to scoop 20. The bucket assembly has a boom 36, an arm 38, and a bucket 40. The boom 36 is controlled by a pair of hydraulic cylinders 42 and 42'. Hydraulic cylinders 42 and 42' allow the boom 36 to be rotated about a pivot point 44. The hydraulic cylinders 42 and 42' lift and lower the boom 36. A hydraulic cylinder 46 has its first end attached to the boom 36 and its second end attached to the arm 38. This allows the arm 38 to be rotated about pivot point 48 to raise and lower the arm 38 relative to the boom 36. A hydraulic cylinder 50 is attached to the arm 38 and attached through suitable linkage to the bucket 40. Actuation of hydraulic cylinder 50 allows the bucket 40 to be rotated in respect to the arm 38 about pivot point 52. A thumb 54 is pivotally attached to the arm 38. A hydraulic cylinder 56 allows the thumb to be rotated about pivot point 58 on arm 38. The thumb 54 can cooperate with the bucket 40 to grasp large objects and either place them into the scoop 20 or remove them out of the way of the scoop 20.

Bucket assembly 34 can be used to excavate an overlying area to the side of the apparatus as, for instance, when profiling a hillside and to take the material removed and place it into the scoop 20. Similarly, bucket assembly 34 can be used to excavate a trench below the level of the apparatus and to lift the material into the scoop 20.

A control cab 59 is attached to frame 2 above one of the pairs of tracks 6. This allows an operator a clear view of the bucket assembly 34, the scoop 20 and the other components of the apparatus.

Referring now to FIG. 2, two additional hydraulic cylinders 60 and 60' have their first ends attached to the frame 2 and their second ends attached to the bucket assembly 34. Actuation of cylinders 60 and 60' allow the bucket assembly 34 to be rotated from side-to-side.

As can be seen in FIG. 2, scoop assembly 20 has upward sloping bottom section 62 and inward sloping side sections 64. This arrangement allows any material collected by the scoop to be forced toward the center portion of the scoop and be collected by a conveyor system 66. The details of conveyor system 66 will be explained below.

Figure 3:
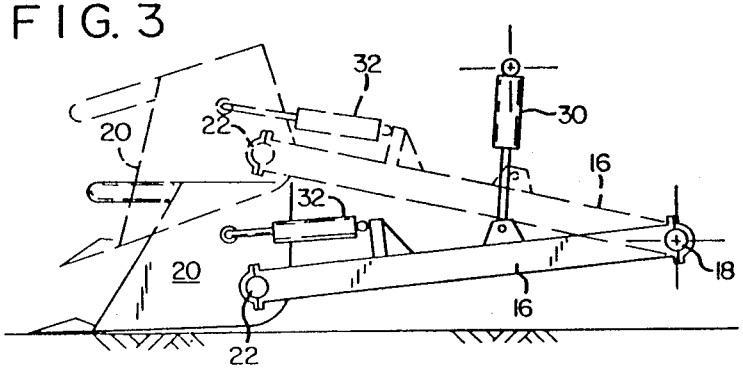
FIG. 3 is a side view of the scoop and push arm of the present invention, showing the range of lift and rotation of the scoop.

Referring now to FIG. 3, it can be seen how hydraulic cylinder 30, when activated, can raise scoop assembly 20 to the position shown by the broken lines of FIG. 3. As cylinder 30 is operated, push arm 16 rotates about the spherical ball joint 18 which is located on the undercarriage frame 8 (not shown). Similarly, hydraulic cylinder 32, when activated, can tilt or rotate the scoop assembly 20 about the spherical ball joint 22.

Figure 4:
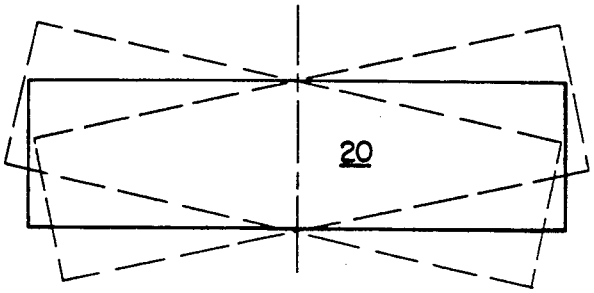
FIG. 4 is a schematic front view of the scoop of the present invention, showing the range of tilt of the scoop.

FIG. 4 is a representation of the scoop assembly 20, as one hydraulic cylinder 30 is operated in relationship to the second hydraulic cylinder 30'. This allows the scoop assembly 20 to be rotated about a longitudinal axis in order to cut the road surface at an angle.

Figure 5:
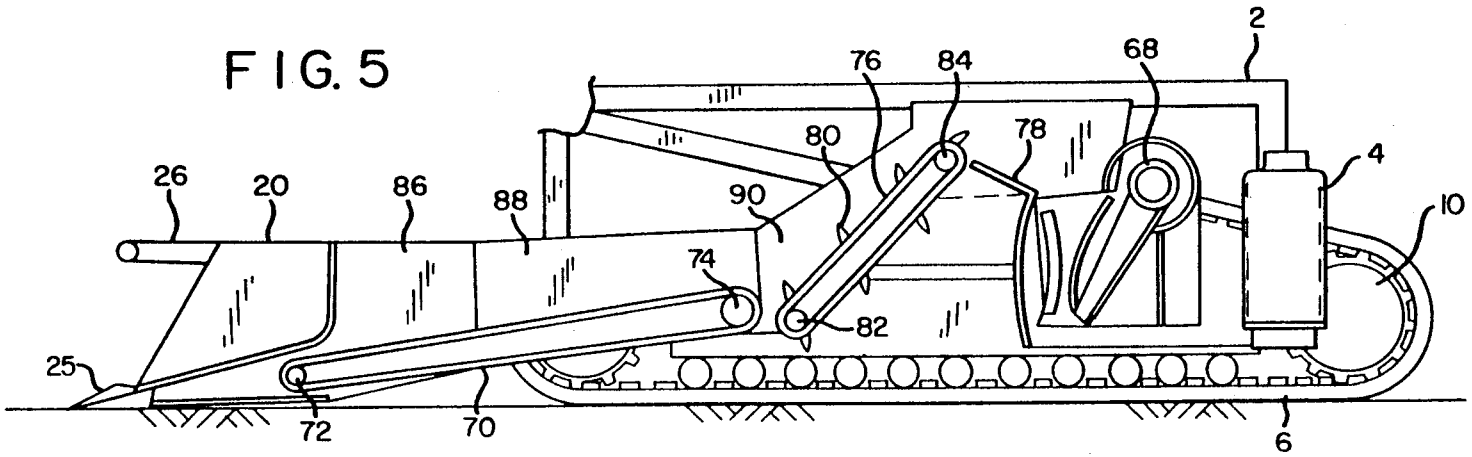
FIG. 5 is a partial, broken-away sectional side view of the apparatus to prepare a road surface of the present invention, taken along lines 5—5 of FIG. 2 and showing a first embodiment of a means to convey material.

Referring now to FIG. 5, a partial cross-sectional view of the apparatus to prepare the road surface is shown with a rock crusher 68 attached to the frame 2. This sectional view is taken along lines 5—5 of FIG. 2 and the bucket assembly 34 has been removed for clarity. A first embodiment of the conveying system 66 for conveying the material collected by the scoop 20 to the rock crusher 68 is shown in FIG. 5. A conveyor 70 has a first end pivoted about pivot point 72. Pivot point 72 lies along the line formed by the intersection of spherical ball joint 22 and corresponding spherical ball joint 22'. The second end of conveyor 70 is pivoted about a pivot point 74 which is in line with the spherical ball joints 18 and 18'. In this manner, as the scoop assembly 20 is raised and lowered and pivoted, the length of conveyor 70 does not change. Conveyor 70 is driven by a hydraulic motor driving conveyor 70 about pivot point 74.

A second conveyor 76 is used to lift the material from conveyor 70 to a grizzly 78. Grizzly 78 is used to separate fine material from the large rock, prior to the rock being deposited in rock crusher 68. Because the lift of conveyor 76 is so steep, rather substantial flights 80 are required on the conveyor 76 to lift the rock up to the grizzly. Conveyor 76 is of a fixed length, having a pivot point 82 lying below the pivot point 74 of conveyor 70. Clearance must be provided between pivot point 74 and pivot point 82 to allow the flights 80 to clear conveyor 70. The second pivot point 84 of conveyor 76 drives the conveyor by means of an additional hydraulic motor (not shown). Sheet metal guides 86 and 88 are located on each side of conveyor 70 to ensure that the material being conveyed by conveyor 70 does not fall to the sides of the conveyor. A similar sheet metal guide 90 is located adjacent conveyor 76, again to prevent the material from falling to the sides of the conveyor. One aspect of this embodiment of the conveyor system is that the lift required by conveyor 76 is rather steep. The opening between conveyor 70 and conveyor 76, that is, between the pivot point 82 and 74, is sufficiently large to allow fine material to fall between the conveyors.

Figure 6:
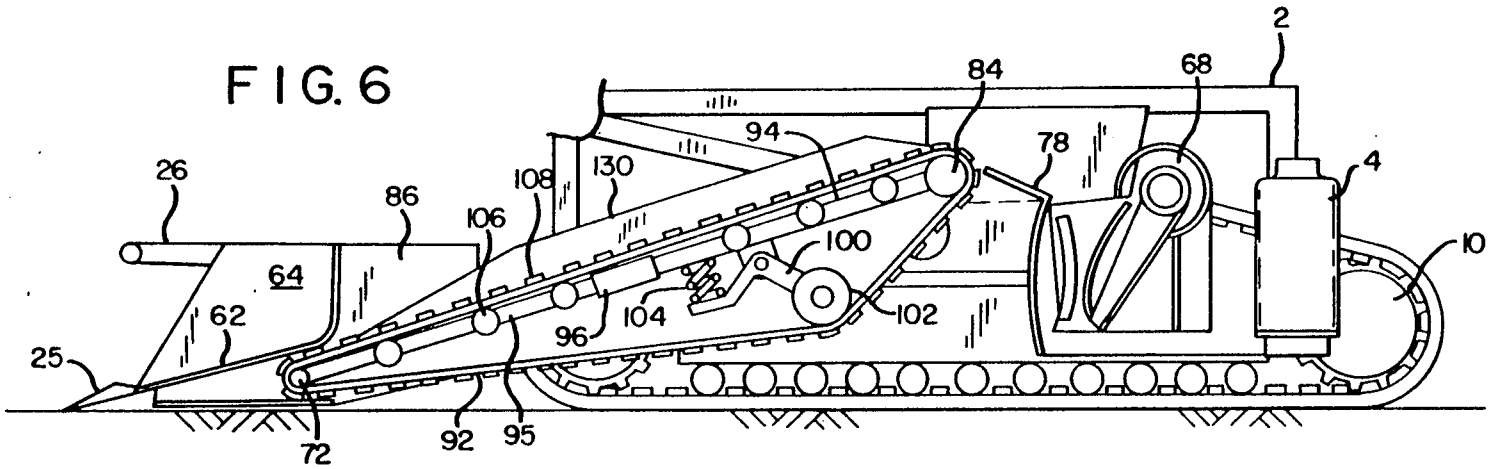
FIG. 6 is a partial, broken-away sectional side view of the apparatus to prepare a road surface of the present invention, taken along lines 5—5 of FIG. 2 and showing a second embodiment of a means to convey material.

A second embodiment of the conveyor system can be seen in FIG. 6. In this, the preferred embodiment of the conveyor system, the conveyor 92 is supported by a pair of parallel arm assemblies 93 and 93', as shown in FIG. 7A. The first parallel arm assembly 93 has an upper arm 94, a lower arm 95 and a slip joint 96. Similarly the second parallel arm assembly 93' has an upper arm 94', a lower arm 95' and a slip joint 96'. The upper arms 94 and 94' and the lower arms 95 and 95' may be solid as shown in FIG. 8 or may be heavy wall rectangular tubing. The slip joints 96 and 96' are heavy wall hollow members having inside dimensions slightly larger than the outside dimensions of arms 94, 94', 95, and 95'. Slip joint 96 is welded to either upper arm 94 or lower arm 95 with the other arm free to slide within the slip joint 96. Slip joint 96' is attached in a similar manner. In the embodiment shown in FIG. 7A, the slip joint 96 is welded to the lower arm 95 and slip joint 96' is welded to lower arm 95'.

Referring also to FIG. 7B, each upper arm 94, 94' and each lower arm 95, 95' has a spherical ball joint 110 welded on the end opposite the slip joint 96. These spherical ball joints 110 allow each arm assembly 93, 93' free rotational movement about the attachment point plus allows each arm assembly a limited rotational movement along their respective centerlines. FIG. 9 shows a cross section of spherical ball joint 110. A spherical ball 112 is restrained in a housing 114. It can be seen in FIG. 9 how the spherical ball 112 can rotate within housing 114. It can also be seen how the ball 112 may rotate to the left or the right in FIG. 9 to allow a limited amount of rotation along the centerline of the arm assemblies 93 and 93'.

Referring back to FIG. 6 it can be seen that spherical ball joint 110 attached to lower arm 95 is attached to pivot point 72. Pivot point 72 is in line with spherical ball joints 22 of scoop 20. The spherical ball joint 110 attached to upper arm 94 is attached at pivot point 84 which is on the frame 2 near the entrance of grizzly 78. This arrangement of attachment points allows the conveyor to make a shallow angle with the ground level. Typically this angle is less than 30° and more particularly about 20°. The conveyor 92 need only lift the overburden approximately 5–6 feet from the scoop 20 to the rock crusher 70. As scoop 20 is raised arm assembly 93 may shorten and as scoop 20 is lowered arm assembly 93 may lengthen. Similarly, as the scoop is rotated as shown in FIG. 4, one arm assembly may contract and the other arm assembly may expand. Each arm assembly 93, 93' may also rotate about its longitudinal axis to compensate for this rotation of scoop 20.

Because the length of the arm assemblies 93, 93' may vary in length, an apparatus consisting of a bell crank arm 100 with pressure roller 102 is provided to maintain the tension in conveyor belt 92. The bell crank arm has a spring 104 which maintains a preset force on roller 102 to maintain the tension in conveyor belt 92. It would be obvious to one skilled in the art that alternate methods of tensioning the conveyor are possible which lie within the scope and spirit of the above disclosure.

Referring now to FIG. 10, it can be seen how the conveyor belting material is supported by the parallel arm assemblies 93 and 93'. A roller 106, attached to a shaft 120, is supported in spherical ball bearings 122 attached to each arm assembly. Only the upper arms 94 and 94' are shown in FIG. 10 but it is understood that similar structures may be attached to arms 95 and 95'. The ladder support arms 94 and 94' are spaced apart approximately 36 inches. The roller 106 is typically 24 inches long and is centered between the arms 94 and 94'. The spherical ball joints 122 allows each arm 94 and 94' to be raised or lowered independently of the other arm and allows the arm to rack independently. One of the advantages of the second embodiment of the conveyor system is that the sides of the conveyor belt can be bent upwardly at up to 45 degrees from the horizontal as the conveyor progresses up the arm assemblies 93 and 93'. This is accomplished by rollers 124 attached to an angle bracket 126. Angle bracket 126 is rigidly attached to the ladder support arm 94. Referring back to FIG. 6, it can be seen how the conveyor material is folded by obscuring the outline of conveyor material 130. In a preferred embodiment of this conveyor system, the total conveyor width is approximately 6 feet. The scoop is approximately 10 feet, 6 inches wide at its opening and the side deflector panel 64 narrows this to approximately 6 feet wide at the scoop opening. At the midpoint length of arm assemblies 93 and 93', the bottom width of the conveyor is approximately 36 inches, with 18 inches on each side being folded up at approximately a 45 degree angle. In this manner, relative short flights are required to lift the material up the conveyor, and side deflector pieces 88 and 90 shown in FIG. 5 are not needed.

Figure 11:
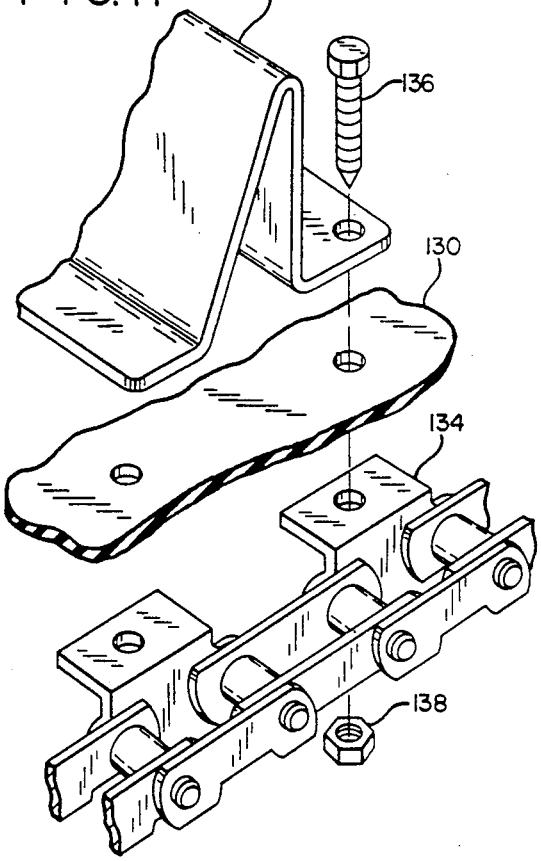
FIG. 11 is an enlarged partial exploded view of the conveyor belt, a drive chain, and a conveyor flight of the FIG. 6 embodiment of the invention.

Referring now to FIG. 11, the flights 108 are attached through the conveyor belting 130 to a conveyor drive chain 134. A suitable threaded fastener 136 securely attaches the flight 108 to the conveyor chain 134 by engaging a mating nut 138. Drive chain 134 is on each side of the conveyor 92 and is approximately 3 feet between each attachment point 136. In this manner, the height of the flight 108 need only be approximately 4 inches tall. The conveyor belting 130 is made of conventional fabric reinforced rubberized material, as is known in the art. The drive chain 134 is a conventional roller-type chain. The drive chain 134 engages a sprocket (not shown) which lies on the pivot point 84 of FIG. 6. This sprocket is driven by a hydraulic motor (not shown).

Figure 12:
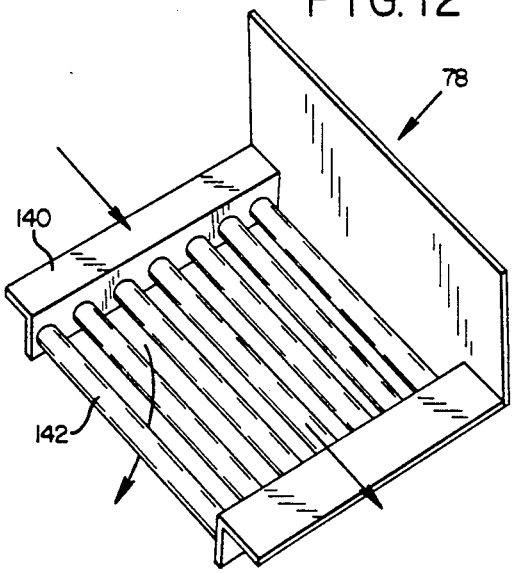
FIG. 12 is a partial perspective view of the material separator of the FIG. 5 and FIG. 6 embodiments of the present invention.

The grizzly 78 as shown in FIG. 12 is a static device used to separate material by size. The grizzly 78 comprises a framework 140 supporting a series of rods 142. The rods 142 are spaced apart, such that fine material falls between the rods, but the larger material is transported across the rods. The rods 142 are arranged in parallel relationship in the direction of travel of the material. In preparing a road surface in which a considerable amount of dirt and other fine material is mixed with the rock to be crushed, the grizzly provides a convenient method to divert the dirt from the rock crusher. In this manner, only oversized rock material is supplied to the rock crusher to be reduced in size. In the preferred embodiment, the spacing between the rods 142 is approximately 1½ inches. A simple metal piece may cover the grizzly if the grizzly is not needed.

Figure 13:
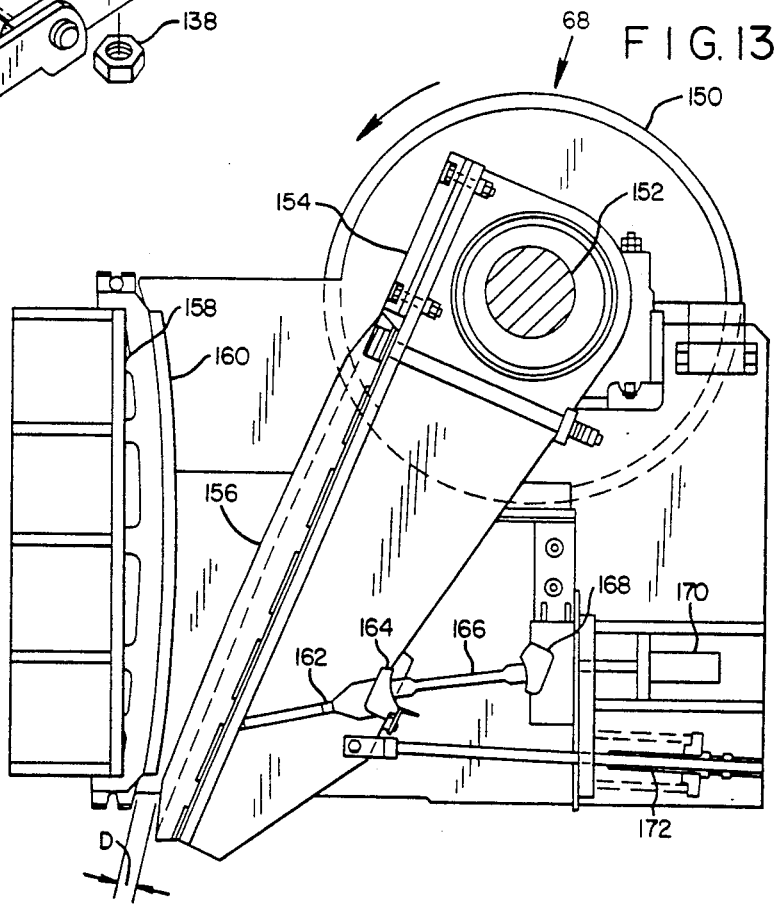
FIG. 13 is an enlarged partial side cross-section of the rock crusher of the present invention.

The rock crusher 68 is a single jaw crusher, as shown in FIG. 13. The rock crusher 68 may be a Model 48-36 single jaw crusher, manufactured by Kobe Steel Limited of Tokyo, Japan. This crusher has an opening at the top that is 48 inches wide and 36 inches long. In this manner, a 36 inch diameter rock can easily be reduced in size. The exit opening of the rock crusher is adjustable, such that the rock is reduced in size to a predetermined amount. In the preferred embodiment, this size will be approximately 2 inches in diameter or smaller.

A hydraulic motor (not shown) drives a flywheel 150 on the rock crusher 68. The flywheel 150 drives an eccentric 152. Attached to the eccentric is a movable jaw 154. Movable jaw 154 has a replaceable shoe 156 attached at the operating side thereof. A stationary shoe 158 is located on the opposite side of the rock crusher from the movable shoe. A replaceable fixed jaw 160 is attached to the fixed shoe.

As the eccentric 152 is rotated, the movable jaw 156 moves toward the fixed jaw 160. A lower toggle 162 is attached to the lower end of the movable jaw 154. This toggle has a toggle seat 164 against which presses a smaller diameter safety toggle 166. The safety toggle 166 is designed in such a manner that, should an overload occur, it will shear, allowing the lower end of the movable jaw 154 to move away from the fixed jaw 160, preventing damage to the crusher. The safety toggle has a seat 168 which is adjustable by a hydraulic cylinder 170. The hydraulic cylinder 170 adjusts the lower jaw opening "D" to adjust the exit size of the rock being crushed. A spring tensioning device 172 keeps the lower end of the movable jaw 154 in proper alignment during operation.

SUMMARY OF OPERATION

As can be seen in the above-detailed description of a preferred embodiment, this apparatus replaces several conventional pieces of road equipment. The apparatus performs the function of a bulldozer in profiling the road surfaces immediately in front of the apparatus. The apparatus functions as an excavator in removing overburden above or below the grade level on each side of the apparatus. The apparatus also acts as a crane in removing oversize material from in front of the excavator.

The apparatus is especially well suited for road work in hilly or mountainous terrain. The mounting of the rock crusher and engine low in the chassis gives the apparatus a very low center of gravity and hence a high degree of stability. The mounting of the conveyor low and central in the chassis also aids the stability of the apparatus. Rock and overburden only needs to be lifted approximately five feet from the scoop to the grizzly and rock crusher. Thus an increase in the amount of rock will not raise the center of gravity appreciably and therefore not upset the stability of the apparatus.

The low placement of the rock crusher also has the advantage of placing the discharge side of the rock crusher close to the road surface. The crushed rock need only fall approximately one foot. This prevents the rock from scattering and presents a uniform four foot wide deposit of crushed rock. The low discharge also prevents the crushed rock from bouncing into the tracks of the vehicle.

The construction of the push bar and scoop allows the apparatus to profile cut the earth surface much like a bulldozer. Compacted material such as gravel, clay, sand and dirt along with embedded rocks may be cut away from the proposed road bed with the cutting edge of the scoop. Loose rocks and boulders as large as thirty six inches in diameter are accepted by the scoop. The scoop and hence the leading cutting edge can be angled from side to side to profile the road surface at an angle. The material thus cut away can be conveyed up the conveyor to the grizzly where the fine material can be separated from the more course material. The larger material is thus reduced in size by the rock crusher and redeposited on the road surface.

The apparatus may also function as a front end loader. In this operating mode, the conveyor is stopped. Overburden, rock or unwanted material is collected in the scoop. The scoop is raised and the vehicle is moved to the location where the unwanted material is to be deposited. The scoop is rotated so that the cutting edge is lowered, thus depositing the material.

Organic material such as tree stumps is not desirable in a road bed underlayment. Usually all stumps and other organic material are removed before road work begins. The present apparatus can remove small stumps and logs with the articulated bucket assembly. The bucket assembly and the scoop in conjunction with one another can uproot small stumps and the bucket assembly can lift these stumps out of the path of the present apparatus.

Another especially beneficial use of the present apparatus is in renewing asphaltic road surfaces. Generally the old road surface must be broken up and hauled away. This necessitates laying a new base for the new pavement. Because the rock crusher is adjustable on its output side for size, it may be set to produce crushed old asphalt pavement fine enough for the new base. Chipper, breaker type teeth are mounted on the leading edge of the scoop. The scoop simultaneously rips and breaks up the old road surface into pieces small enough to be conveyed to the rock crusher. The rock crusher reduces the size of the old pavement small enough to be used as underlayment for the new road surface.

Of course, it should be understood that a wide range of changes and modifications can be made to the preferred embodiment described above. It is, therefore, intended that the foregoing description be regarded as illustrative rather than limiting, and that it be understood that it is the following claims, including all equivalents, which is intended to define the scope of the invention.

I claim:

1. A road surface preparation apparatus to prepare a road surface, comprising:

a frame having opposing front and rear ends with a longitudinal axis extending therebetween;

a propelling means to propel the frame;

a pair of push bars having proximate and distal ends, each of the pair of push bars located at opposite sides of the longitudinal axis with the proximate end of each push bar pivoted to the frame adjacent the front end thereof and extending forwardly therefrom, with the pivotal points of the proximate end of the push bars defining a first transverse axis;

a road-profiling material collector for collecting material and profiling the road surface to a desired profile, the material collector pivoted between the distal ends of the pair of push bars, with the pivotal points of the distal end of the push bars defining a second transverse axis;

a first conveyor coupling the material collector with the frame, the first conveyor including a first roller mounted to the frame for rotation about the first transverse axis, a second roller mounted to the material-collector for rotation about the second transverse axis, and an endless belt extending between the first and second rollers, the first conveyor delivering material from the material collector to the frame;

a second conveyor mounted to the frame to receive material delivered thereto from the first conveyor; and a crusher mounted to the frame to receive and crush material delivered thereto from the second conveyor, the crusher depositing the crushed material onto the profiled road surface.

2. A road surface preparation apparatus to prepare a road surface, comprising:

a frame having opposing front and rear ends with a longitudinal axis extending therebetween;

a propelling means to propel the frame;

a pair of push bars having proximate and distal ends, each of the pair of push bars located at opposite sides of the longitudinal axis with the proximate end of each push bar pivoted to the frame adjacent the front end thereof and extending forwardly therefrom;

a road-profiling material collector for collecting material and profiling the road surface to a desired profile, the material collector pivoted between the distal ends of the pair of push bars, with the pivotal points of the distal ends of the push bars about which the material collector pivots defining a transverse axis;

a conveyor coupling the material collector with the frame, the conveyor having plural rollers including a first roller mounted to the frame and a second roller mounted to the material collector for rotation about the transverse axis, an endless belt supported by the plural rollers and extending between the first and second rollers, and a pair of variable length conveyor arms supporting the plural rollers with each conveyor arm varying in length in response to motion of the material collector with respect to the frame; and a crusher mounted to the frame to receive and crush material delivered thereto from the conveyor, the crusher depositing the crushed material onto the profiled road surface.

3. A road surface preparation apparatus according to claim 2 wherein the conveyer includes a conveyor tensioning device for maintaining a predetermined tension on the endless belt, with the conveyor tensioning device including a bell crank arm having a pressure roller pivoted thereto and a spring to maintain a predetermined force on the pressure roller to maintain a predetermined tension in the endless belt.

4. A road surface preparation apparatus to prepare a road surface, comprising:

frame having opposing front and rear ends with a longitudinal axis extending therebetween;

a propelling means to propel the frame;

a pair of push bars having proximate and distal ends, each of the pair of push bars located at opposite sides of the longitudinal axis with the proximate end of each push bar pivoted to the frame adjacent the front end thereof and extending forwardly therefrom;

a road-profiling material collector for collecting material and profiling the road surface to a desired profile, the material collector pivoted between the distal ends of the pair of push bars, with the pivotal points of the distal ends of the push bars about which the material collector pivots defining a transverse axis;

a pair of material collector lifting fluid cylinders coupling each push bar to the frame to raise and lower the material collector relative to the frame;

a pair of material collector rotational fluid cylinders coupling the material collector to each push bar for rotation about the transverse axis;

a conveyor system coupling the material collector with the frame to deliver material from the material collector to the frame; and a crusher mounted to the frame to receive and crush material delivered thereto from the conveyer system, the crusher depositing the crushed material onto the profiled road surface.

5. A road surface preparation apparatus to prepare a road surface, comprising:

a self-propelled frame having opposing front and rear ends;

a road-profiling material collector pivoted to the frame adjacent the front end thereof and extending forwardly therefrom for profiling the road surface to a desired profile by collecting material therein;

a conveyor system coupling the material collector with the frame to deliver material form the material collector to the frame;

a crusher mounted to the frame to receive and crush material delivered thereto form the conveyer system, the crusher depositing the crushed material onto the profiled road surface; and wherein the material collector has a bucket portion, with the bucket portion having two opposing sidewalls, a cutting edge, and an oversized material deflector member extending between said opposing sidewalls, with the deflector member extending forwardly from the bucket portion and being positioned a predetermined distance above the cutting edge to prevent material having a diameter larger than the predetermined distance from entering the bucket portion.

6. A road surface preparation apparatus to prepare a road surface, comprising:

a self-propelled frame having opposing front and rear ends;

a road-profiling material collector pivoted to the frame adjacent the front end thereof and extending forwardly therefrom for profiling the road surface to a desired profile by collecting desirable and undesirable material therein, the material collector also pivoted to the frame for dumping the undesirable material therefrom;

a conveyor system coupling the material collector with the frame to deliver desirable material from the material collector to the frame; and a crusher mounted to the frame to receive and crush the desirable material delivered thereto from the conveyer system, the crusher depositing the crushed desirable material onto the profiled road surface.

7. A road surface preparation apparatus to prepare a road surface, comprising:

a self-propelled frame having opposing front and rear ends with a longitudinal axis extending therebetween;

a road-profiling material collector pivoted to the frame adjacent the front end thereof and extending forwardly therefrom for profiling the road surface to a desired profile by collecting material therein;

a conveyor system coupling the material collector with the frame to deliver material from the material collector to the frame;

a crusher mounted to the frame to receive and crush material delivered thereto from the conveyer system, the crusher depositing the crushed material onto the profiled road surface; and a static separator between the conveyor and the crusher to separate the material by size into fine material which falls through the separator and larger material for deposit in the crusher, the separator comprising a plurality of rods arranged in parallel relationship in a direction of travel of the material between the conveyor and the crusher.

8. A method of preparing a road surface from substantially unimproved terrain, the method comprising the steps of:

propelling a road surface preparation apparatus over the substantially unimproved terrain, the apparatus having a road-profiling material collector and a crusher;

profiling the substantially unimproved terrain with the road-profiling material collector to provide a profiled road bed by removing overburden from the terrain, with the overburden comprising desirable and undesirable portions;

collecting the undesirable portion of the overburden removed in the profiling step with the material collector;

moving the apparatus to a dump location where the undesirable portion of the overburden is to be deposited;

dumping the undesirable portion of the overburden from the material collector at the dump location;

collecting the desirable portion of the overburden removed in the profiling step with the material collector;

crushing the collected desirable portion of the overburden using the crusher; and depositing the crushed desirable portion of the overburden on the profiled road bed during the propelling step to provide the road surface.

9. A method of preparing a road surface according to claim 8, wherein:

the propelling step comprises propelling a road surface preparation apparatus having a conveyor system coupling the material collector to the crusher, and a static separator between the conveyor system and the crusher, the separator comprising a plurality of rods arranged in parallel relationship in a direction of travel of the material between the conveyor and the crusher;

the method further includes the step of conveying the desirable portion of the overburden from material collector to the crusher using the conveyor; and the method also includes, prior to the crushing step, the step of separating the desirable portion of the overburden by size into fine material which falls through the separator onto the road bed and into larger material for deposit in the crusher.

10. A method of preparing a road surface according to claim 8, wherein:

the propelling step comprises propelling a road surface preparation apparatus having a material collector which has a bucket portion with a cutting edge and an oversized material deflector member, with the deflector member extending forwardly from the bucket portion and being positioned a predetermined distance above the cutting edge; and the method further includes the step of deflecting oversized undesirable portions of the overburden having a diameter larger than the predetermined distance to prevent such oversized overburden from entering the bucket portion of the material collector.

11. A method of preparing a road surface according to claim 8, wherein:

the propelling step comprises propelling a road surface preparation apparatus having an articulated bucket assembly with a boom, an arm, and a bucket; and the method further includes the step of excavating a trench alongside the road bed using the articulated bucket assembly.

12. A method of preparing a road surface according to claim 8, wherein:

the road surface preparation apparatus includes an articulated bucket assembly; and the step of collecting the undesirable portion of the overburden includes the step of loading the undesirable portion of the overburden into the material collector using the articulated bucket assembly.

* * * * *